US005915459A

United States Patent [19]

Urlau et al.

[11] Patent Number: 5,915,459

[45] Date of Patent: Jun. 29, 1999

[54] METHOD AND EQUIPMENT FOR THE INTEGRAL CASTING OF METAL STRIP CLOSE TO ITS FINAL DIMENSIONS

[75] Inventors: Ulrich Urlau, Moers; Helmut Schlechtriem, Duisburg; Wolfgang Reichelt, Moers; Ewald Feuerstacke, Dorsten, all of Germany

[73] Assignee: Mannesmann Aktiengesellschaft, Düsseldorf, Germany

[21] Appl. No.: 08/666,512

[22] PCT Filed: Dec. 14, 1994

[86] PCT No.: PCT/DE94/01519

§ 371 Date: Jul. 24, 1996

§ 102(e) Date: Jul. 24, 1996

[87] PCT Pub. No.: WO95/17987

PCT Pub. Date: Jul. 6, 1995

[30] Foreign Application Priority Data

Dec. 27, 1993 [DE] Germany ..... 43 44 953

[51] Int. Cl.[6] ..... B22D 11/06; B22D 11/10

[52] U.S. Cl. ..... 164/479; 164/429; 164/437; 164/489; 222/595; 266/239

[58] Field of Search ..... 164/479, 463, 164/489, 423, 429, 437; 222/595; 266/239

[56] References Cited

U.S. PATENT DOCUMENTS

| | | | |
|---|---|---|---|
| 1,180,728 | 4/1916 | Klocke | 164/479 X |
| 3,412,899 | 11/1968 | Sutter | 222/595 |
| 5,063,989 | 11/1991 | Powell et al. | 164/463 |
| 5,170,839 | 12/1992 | Feuerstacke et al. | 266/239 X |
| 5,538,071 | 7/1996 | Johansson et al. | 164/489 X |
| 5,547,014 | 8/1996 | Bruckner et al. | 164/437 |

FOREIGN PATENT DOCUMENTS

| | | | |
|---|---|---|---|
| 51-14826 | 2/1976 | Japan | 164/437 |
| 58-29551 | 2/1983 | Japan | 164/437 |
| 2-155540 | 6/1990 | Japan | 164/437 |

*Primary Examiner*—J. Reed Batten, Jr.

*Attorney, Agent, or Firm*—Cohen, Pontani, Lieberman & Pavane

[57] ABSTRACT

Metal strip close to its final dimensions is cast using a strip-casting apparatus provided with a melt-holding vessel and a conveyor belt, in which a metal melt, in particular steel, flows out of a casting nozzle of a closable pouring chamber which can be put under vacuum and is connected via a siphon to a main chamber which can be put under pressure. The casting nozzle is inclined by about 45° and is of trumpet-like configuration in the region of the orifice on the inside of the nozzle wall remote from the main chamber. Additionally, a shut-off element which can be opened in a slit-shaped manner is provided near the orifice of the casting nozzle.

9 Claims, 4 Drawing Sheets

METHOD AND EQUIPMENT FOR THE INTEGRAL CASTING OF METAL STRIP CLOSE TO ITS FINAL DIMENSIONS

BACKGROUND OF THE INVENTION

1. Field of the Invention

The invention relates to a method of integrally casting metal strip close to its final dimensions on a strip-casting apparatus provided with a melt-holding vessel and a conveyor belt. A metal melt, in particular of steel, flows out via a casting nozzle from a closable pouring chamber which can be put under vacuum and is connected via a siphon to a main chamber which can be put under pressure.

2. Description of the Prior Art

During the integral casting of a strip-casting apparatus for producing metal strip close to its final dimensions, air inclusions in the casting nozzle lead to considerable impediments in the casting operation.

EP 0 534 174 discloses methods and the equipment required therefor, which are intended to expel the air from the casting nozzle and the region located upstream. Here, it is first of all proposed to initially set in the melt distributor a filling level which corresponds at most to the conveyor-belt plane and to set during the integral casting such a filling level which expels the melt from a casting nozzle which is curved in a U-shape. It has been found in practice that air collects in the center upper region of the casting nozzle which is curved downward in a U-shape. This essentially leads to the occurrence of an uncontrollable starting surge which can prevent feeding of the strand.

It is therefore also proposed in the EP 0 534 174 to provide a pouring chamber between the melt distributor and the casting nozzle and, during the integral casting—when the inlet of the casting nozzle arranged downstream of a siphon is closed relative to the metal melt—to build up a vacuum in the pouring chamber and to expel the air upward in the casting nozzle.

Even during this procedure, impediments during the integral casting cannot be avoided, since the air bubbles rise in opposite direction to the flow of the metal melt. During the process, uncontrollable constrictions in parts of the casting nozzle occur, which in turn result in an unwanted effect on the spreading of the metal melt on the conveyor belt.

SUMMARY OF THE INVENTION

With knowledge of the known difficulties, it is an object of the present invention to provide a method and the equipment required therefor, by which reliable expulsion of the air during the starting phase is ensured.

Pursuant to this object, and others which will become apparent hereafter, one aspect of the present invention resides in a method for integrally casting metal strip close to its final dimensions with a strip-casting apparatus having a melt-holding vessel which defines a closeable pouring chamber which can be put under vacuum and a main chamber which can be put under pressure and is connected to the pouring chamber by a siphon. A conveyor belt is provided and a casting nozzle is connected to the pouring chamber and has an orifice facing the conveyor belt. The method includes closing the orifice of the casting nozzle before casting begins, filling the main chamber and the pouring chamber with a liquid metal so that melt levels $\Delta h_A$ (initial level before casting) and $\Delta h_G$ (level during casting) are set at a value of $\alpha h_A \Delta h_G > 5$ in the main chamber relative to a liquid metal level present in a stationary operating state on the conveyor belt. Next, the casting nozzle is opened in a slit-shaped manner on a side of the nozzle inclined toward the main vessel to begin casting so that a liquid metal velocity directed downward is greater than an uplift velocity of gas bubbles penetrating the liquid metal. The differential melt level $\Delta h_G$ in the main chamber is lowered, while simultaneously continuously maintaining the casting nozzle open until the orifice area is completely cleared, to a value slightly above the liquid level on the conveyor belt, so as to permit siphoning.

The inventive apparatus for strip casting metal strip close to final dimensions includes a conveyor belt, and a melt holding vessel including a main chamber and a pouring chamber. The pouring chamber has a casting nozzle arranged above the conveyor belt, which casting nozzle is inclined approximately 45° and defines an orifice. The nozzle further has a sidewall remote from the main chamber with an inner side surface of a trumpet-like configuration (i.e., a partial flaring bell construction or a partial hyperboloid). Shut-off means are provided near the orifice for closing access to the casting nozzle. The shut-off means is also openable in a slit-shaped manner.

Before casting begins, the casting nozzle is filled with liquid melt up to the shut-off located in the region of the orifice. Shut-off members are used that permit controlled opening, specifically in such a way that there is a slit over the entire width of the casting nozzle at the start of opening. In this case, the casting pressure is selected so that the melt discharges with a higher velocity during this first slit-shaped opening of the orifice of the casting passage. During the process, the air located below the shut-off means is entrained. In addition, this entraining of the extremely small quantities of air in the region of the orifice of the casting nozzle is assisted by the trumpet-like configuration of the remote inside of the casting nozzle in the metal-holding vessel.

It has been found that air prefers to flow in an opposite direction to the outflowing metal when a vacuum is used in the region above the casting nozzle. It is therefore proposed to hinder this unwanted flow path of the air to the greatest possible extent.

To this end, the pressure resistance at the orifice of the nozzle is increased by obstacles. The elements used for this are preferably self-consuming so that they do not hinder the subsequent casting operation.

BRIEF DESCRIPTION OF THE DRAWING

An example of the invention is shown in the attached drawing, in which.

DETAILED DESCRIPTION OF THE PREFERRED EMBODIMENTS

Figure 1A:
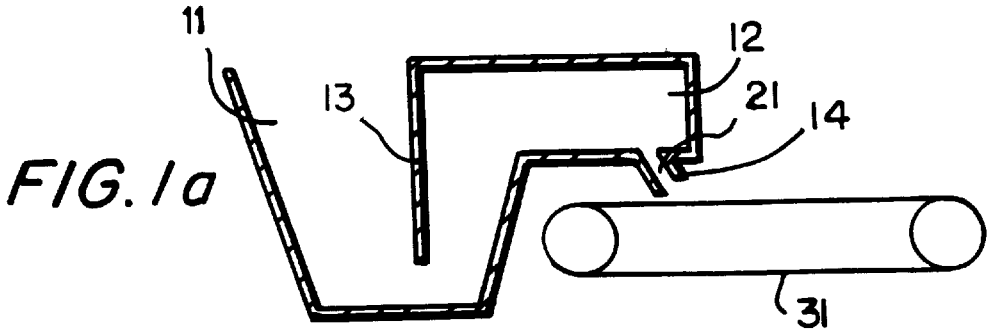
FIG. 1 shows a diagram of a starting phase of a casting process of the invention.

FIG. 1 diagrammatically shows the starting phase of the method. Before the start of casting, the casting vessel, having a main chamber 11 and a pouring chamber 12, is empty, a shut-off element 21 in the casting nozzle 14 is closed, and the conveyor belt 31 is stationary (FIG. 1*a*).

Figure 1B:
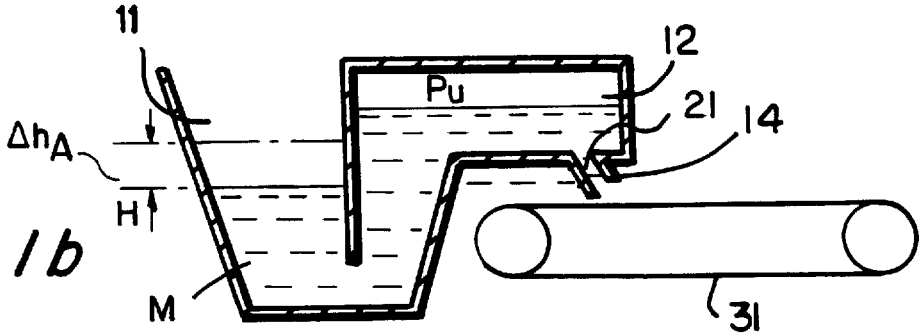
Figure 1C:
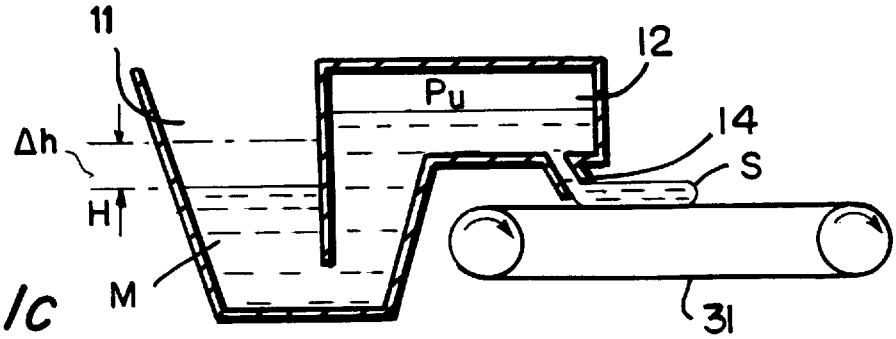

The main chamber 11 and the pouring chamber 12 are separated by a wall 13. Just before the start of casting, the casting vessel is filled with melt M, specifically in such a way that the melt level in the pouring chamber 12 is raised by vacuum $P_u$ and a differential melt level of $\Delta h_A$ is set in the main chamber (FIG. 1*b*). The differential level A h refers to the liquid-metal level H obtained during the casting operation on the conveyor belt or on the inside 16 of the casting nozzle 14, inclined toward the conveyor belt 31.

Figure 1D:
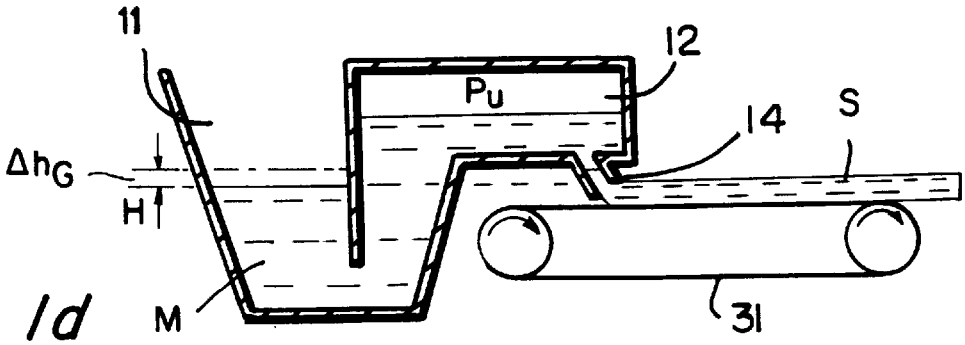

At the start of casting (FIG. 1*c*), the conveyor belt 31 is started and the shut-off element 21 is opened in a slit-shaped manner. The liquid metal M discharges from the casting nozzle with a considerable surge and is formed into a cast strand S. During this starting phase, the shut-off element 21 is opened continuously. As a function of the metal quantity fed to the main vessel, the differential melt level A h is reduced down to the operating level $\Delta h_G$ (FIG. 1*d*).

Figure 2:
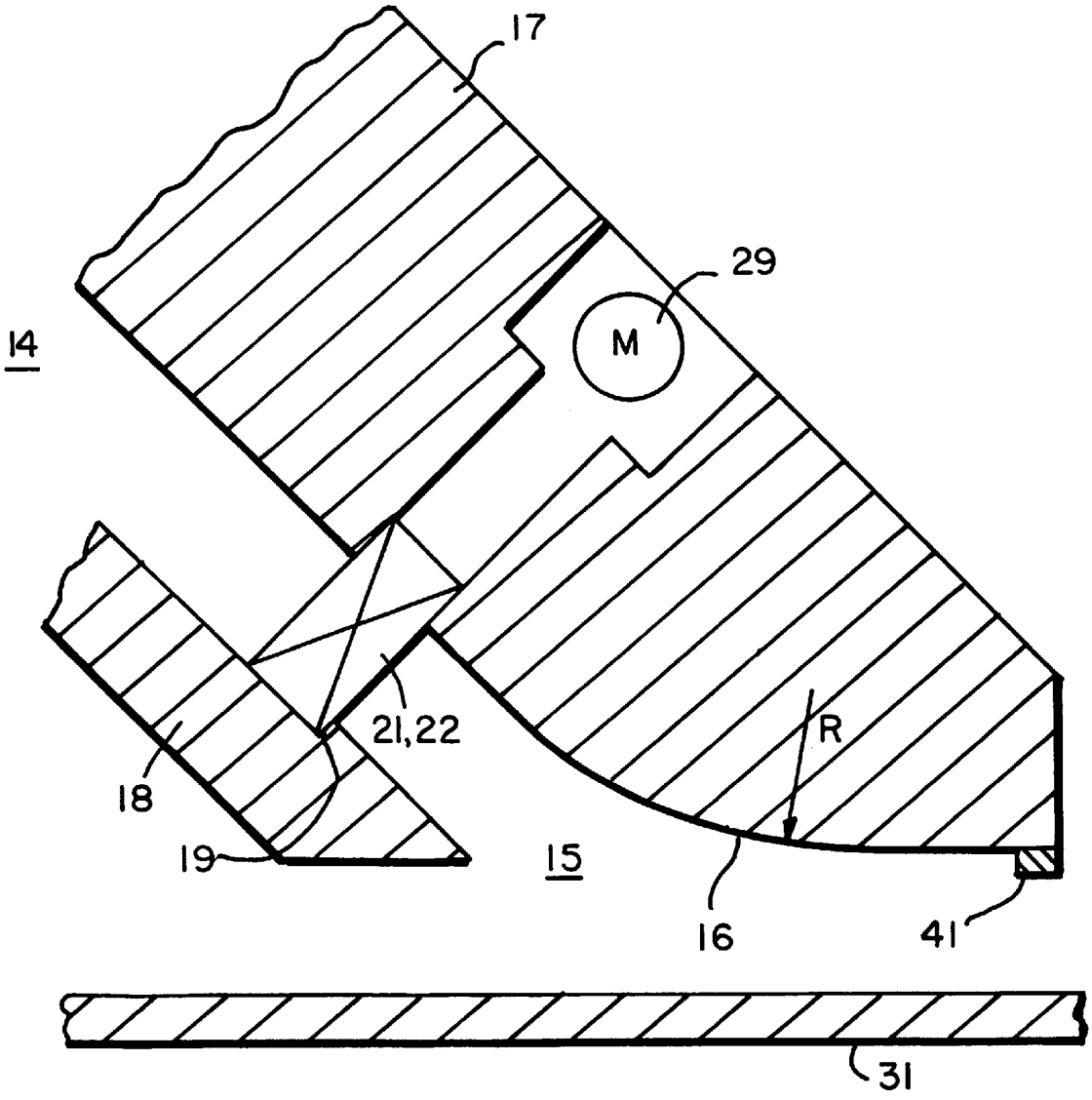
FIGS. 2 to 4 show the form of the orifice of the casting nozzle for shut-off elements of various configuration.
Figure 3:
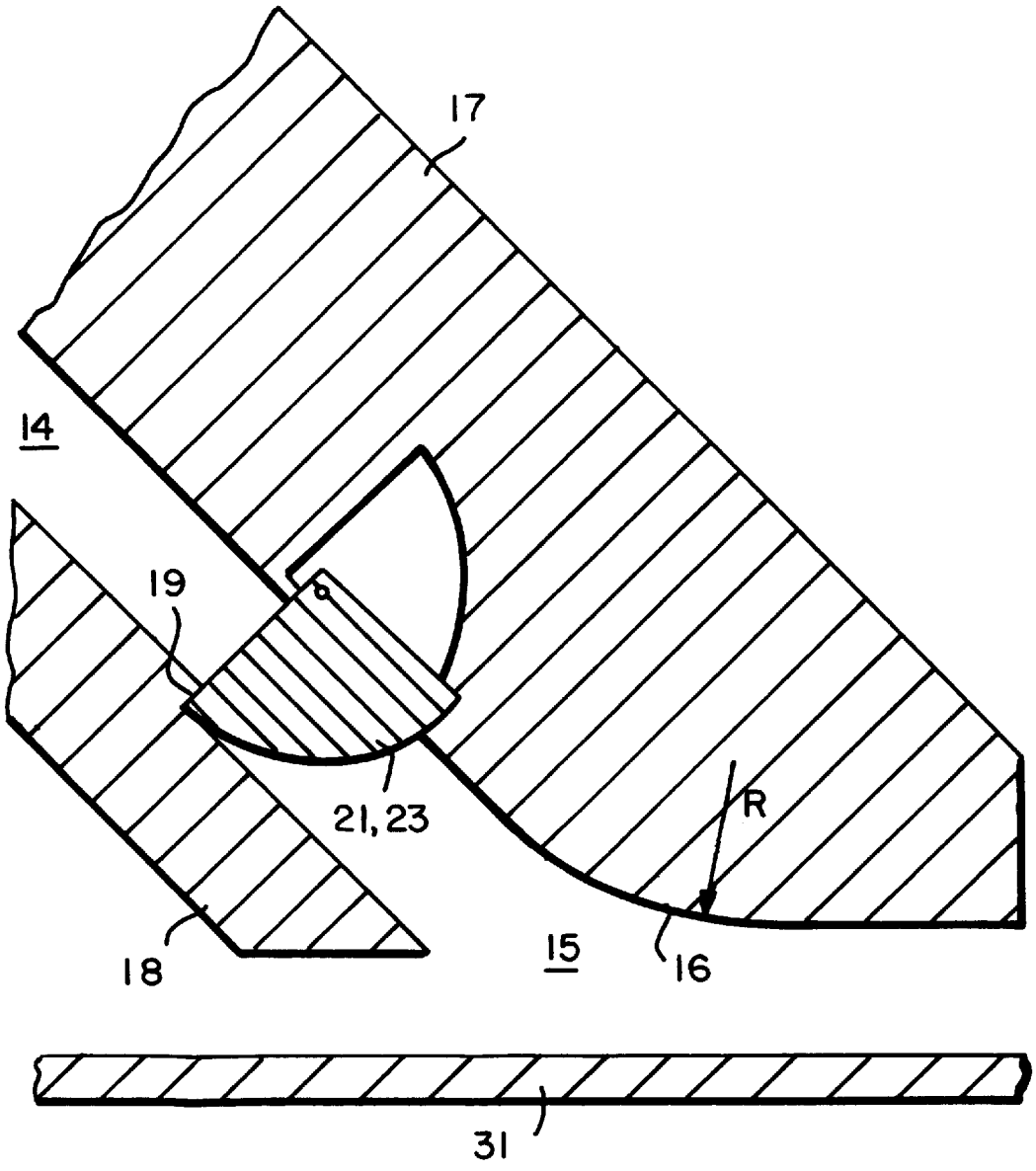
Figure 4:
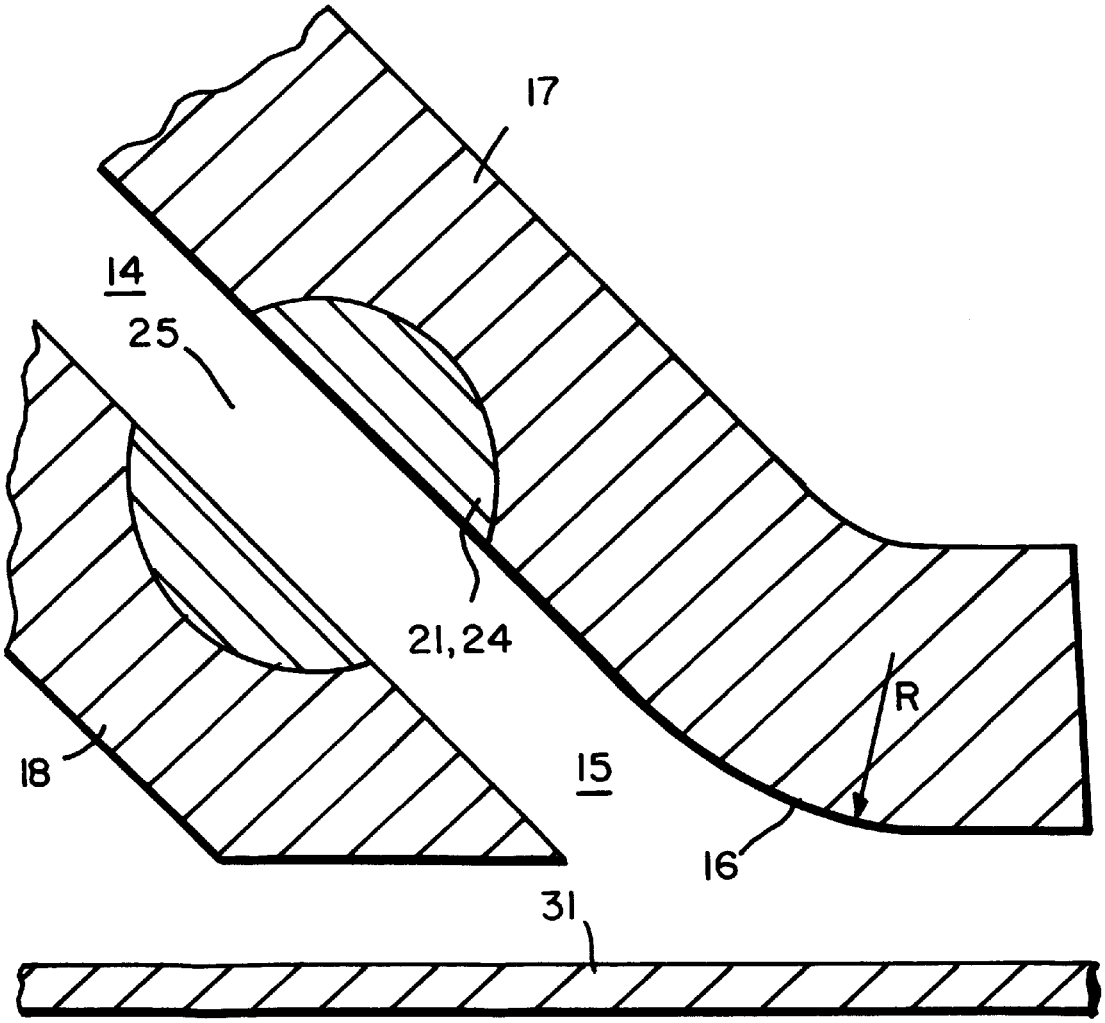

FIGS. 2 to 4 show the bottom section of the casting nozzle 14 for shut-off elements 21 of various configuration. An orifice 15 formed by a wall 17 remote from the main chamber 11 and a wall 18 inclined toward the main chamber, is shown in section. The inside 16 of the wall 17 is of trumpet-like (i.e., flaring bell shape) configuration. In this case, it has a radius R which connects the casting nozzle, inclined by about 45°, to the side inclined parallel to the conveyor belt 31. At the end of the orifice 15, an element 41 is arranged on the wall 17. The element 41 serves to increase pressure resistance and projects into the free space between the conveyor belt 31 and the inside 16. The element 41 can be formed of a material that can be thermally consumed, such as a low melting point metal.

In FIG. 2, the shut-off element 21 is configured as a plate slide valve 22 which is displaceable via a drive 29 such as a motor. In its closed position, the plate slide valve 22 rests against a step 19 in the wall 18.

In FIG. 3, the shut-off element 21 is designed as a flap 23. In the closed position, the flap 23 rests against a step 19 in the wall 18. In the open position, the flap 23 is swung via a drive (not shown in more detail) into the wall 17 to such an extent that a plate side forms a plane with the inside 16.

In FIG. 4, a shaft 24 is provided as shut-off element 21, which shaft 24 has a recess 25 which clears the casting nozzle without hindrance in accordance with the rotary position of the shaft 24.

In FIG. 4, the walls 17 and 18 have the same wall thickness for the purpose of thermal adaptation.

We claim:

1. A method for integrally casting metal strip close to its final dimensions with a strip-casting apparatus provided with a melt-holding vessel having a closable pouring chamber which is connected via a siphon to a main chamber a conveyor belt, and a casting nozzle connected to the pouring chamber and having an orifice facing the conveyor belt, the method comprising the steps of: closing the orifice of the casting nozzle before casting begins; filling the main chamber and the pouring chamber with liquid metal so that differential melt levels $\Delta h_A$ (initial) and $\Delta h_G$ (casting) are set at a value of $\Delta h_A/\Delta h_G>5$ in the main chamber relative to the liquid metal level H present in a stationary operating state on the conveyor belt; producing a vacuum in the pouring chamber; opening the casting nozzle in a slit-shaped manner on a side of the nozzle inclined toward the main vessel to begin casting so that a liquid metal velocity directed downward is greater than an uplift velocity of gas bubbles penetrating the liquid metal; and, while simultaneously continuously opening the casting nozzle until the orifice area is completely cleared, lowering the differential melt level $\Delta h_G$ in the main chamber to a value slightly above the liquid metal level H on the conveyor belt so as to permit siphoning.

2. A method for integrally casting according to claim 1, and further comprising the step of increasing pressure resistance at the nozzle orifice in a counterflow direction to the liquid metal at least during casting.

3. An apparatus for strip casting of metal strip close to its final dimensions, comprising: a conveyor belt; a melt holding vessel including a main chamber and a pouring chamber with a casting nozzle arranged above the conveyor belt, the casting nozzle being inclined approximately 45° and defining an orifice, the nozzle having a sidewall remote from the main chamber with an inner side surface of trumpet-like configuration in a region of the orifice; and shut-off means provided near the orifice of the casting nozzle for closing access to the casting nozzle so that a back flow of gas bubbles against the melt into the pouring chamber is prevented, the shut-off means being openable in a slit-shaped manner.

4. An apparatus according to claim 3, wherein the shut-off means includes a plate slide valve.

5. An apparatus according to claim 3, wherein the shut-off means includes a flap pivotable about an axis arranged at the sidewall of the casting nozzle.

6. An apparatus according to claim 3, wherein the shut-off means includes a rotatable shaft having a recess comprising at least half a cross-sectional area of the shaft and being rotatably arranged in a casting passage of the casting nozzle.

7. An apparatus according to claim 3, and further comprising an element arranged on the sidewall of the nozzle at an outlet of the orifice so as to increase pressure resistance in a counterflow direction of liquid metal.

8. An apparatus according to claim 7, wherein the pressure increasing element is formed of a material which can be thermally consumed.

9. An apparatus according to claim 8, wherein the pressure increasing element is made of a low melting point metal.

* * * * *